US006637739B2

(12) United States Patent
Neri

(10) Patent No.: US 6,637,739 B2
(45) Date of Patent: Oct. 28, 2003

(54) DEVICE FOR BANDING GROUPS OF SHEETS

(75) Inventor: Armando Neri, Bologna (IT)

(73) Assignee: Currency Systems International, Inc., Irving, TX (US)

( * ) Notice: Subject to any disclaimer, the term of this patent is extended or adjusted under 35 U.S.C. 154(b) by 244 days.

(21) Appl. No.: 09/734,735

(22) Filed: Dec. 13, 2000

(65) Prior Publication Data

US 2001/0028139 A1 Oct. 11, 2001

(30) Foreign Application Priority Data

Dec. 20, 1999 (IT) ..... BO99A0696

(51) Int. Cl.[7] ..... B65H 33/04
(52) U.S. Cl. ..... 270/52.18; 53/529; 101/232
(58) Field of Search ..... 270/52.18; 101/232; 100/2, 3, 5, 6, 25, 26, 27, 28; 156/443, 468; 53/396, 412, 414, 416, 419, 450, 447, 117, 234, 529, 586

(56) References Cited

U.S. PATENT DOCUMENTS 1,875,260 A * 8/1932 Parker ..... 100/28
3,712,020 A * 1/1973 Norr et al. ..... 53/412
4,111,116 A * 9/1978 Ito et al. ..... 53/586
4,126,982 A * 11/1978 Ito et al. ..... 53/593
4,341,056 A * 7/1982 Leanna et al. ..... 53/529
4,543,768 A * 10/1985 Nishikawa et al. ..... 53/117
5,733,099 A * 3/1998 Honneger ..... 271/216
5,970,866 A * 10/1999 Okawa ..... 101/232
5,987,847 A * 11/1999 Nordstrom et al. ..... 53/234

* cited by examiner

*Primary Examiner*—Eugene H. Eickholt
(74) *Attorney, Agent, or Firm*—Colin P. Cohen; Carstens, Yee & Cahoon, LLP

(57) ABSTRACT

A group of banknotes aligned and stacked on a longitudinal axis is positioned at the work station of a banding device by a clamp type gripper that compresses a first longitudinal portion of the group along the direction of the axis, ready to be secured with at least one band of strip material; as the compressive force is applied, parts of the notes forming a second longitudinal portion of the group, not directly compressed by the gripping device, are caused to fan out at the top and bottom ends of this same second portion, and accordingly, the banding device includes a finger and a locating surface impinging respectively on the two ends of the second portion and operating in conjunction to compact and smooth the parts of the banknotes coinciding with these same ends.

23 Claims, 6 Drawing Sheets

DEVICE FOR BANDING GROUPS OF SHEETS

BACKGROUND OF THE INVENTION

The present invention relates to a device for banding groups of sheets.

The invention finds application to advantage in machines by which banknotes, in particular soiled banknotes, are ordered into groups and transferred to a strapper/bander by which at least one band is looped around each single group of notes.

It is well known that banks need to move notable amounts of paper money around on a daily basis, whether central banks by which new banknotes are issued, or trading banks through which the notes are circulated. To this end, banknotes are first sorted into groups and then placed for the purposes of transportation into relative bags or cassettes.

To ensure they can be ordered and transported without the risk of breaking up and to prevent their being tampered with, the groups are secured with bands serving to keep the notes together and minimize opportunities for robbery or pilfering.

Generally speaking, banknotes are fed singly and in succession into a machine of the aforementioned type and, having been examined and sorted according to denomination and/or type, directed separately toward the outlets of respective channels along which the groups are formed.

In this way stacks of single banknotes are formed at each of the outlets and, as the single notes are accumulated in a predetermined number corresponding to one group, taken up and transferred to a station at which it will be suitably strapped or banded.

In view of the considerations mentioned above, the strapping or banding operation needs to be fast and accurate, resulting in an end product characterized by strength and quality.

The prior art embraces machines for strapping and banding groups of banknotes comprising a unit by which a group of notes is gripped, a unit by means of which a continuous strip of material decoiling from a roll is advanced and positioned around the group of notes, and a cutting and sealing unit by which the continuous strip is severed to produce a discrete length and the two ends of the separated length are secured together to form a band.

One of the drawbacks encountered in such machines is attributable to the fact that when the group of sheets is taken up by the gripping device, which operates generally by impinging on the two opposite end faces of the group and applying a compressive force, the section subjected to the gripping action is compacted substantially into a wad, whereas the parts of the sheets not subjected directly to the gripping action tend to fan out in relation to the compacted part.

This effect is especially noticeable in the case of soiled banknotes, due to their imperfect surface flatness and irregular appearance, and to the fact that they are creased.

Because the banding operation is carried out, of necessity, while the group of notes is subject to the action of the gripping device, the positioning of the strip and the arrangement of the banknotes at the fanned-out areas may be incorrect, with the result that the shape of the group of notes when banded appears irregular.

Accordingly, and for the reasons outlined above, machines of the type in question are limited in terms of operating capacity, lacking in precision and not altogether reliable.

The object of the invention is to set forth a device for banding groups of sheets, in particular soiled banknotes, around which bands can be applied both accurately and in such a way as to guarantee strength and quality of the end result.

SUMMARY OF THE INVENTION

The stated object is realized according to the invention in a device for banding groups of sheets appearing substantially parallelepiped in shape, wherein the sheets are caused to accumulate along a longitudinal stacking axis, taken up by respective gripping means engaging two longitudinally opposite ends of at least a first longitudinal portion of the resulting group and fed thus to a station where at least one band of a strip material is applied.

The device disclosed comprises compacting means designed to compress at least a second longitudinal portion of the single group not engaged by the gripping means, in such a way as to position the group of sheets in a configuration of readiness for application of the band.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
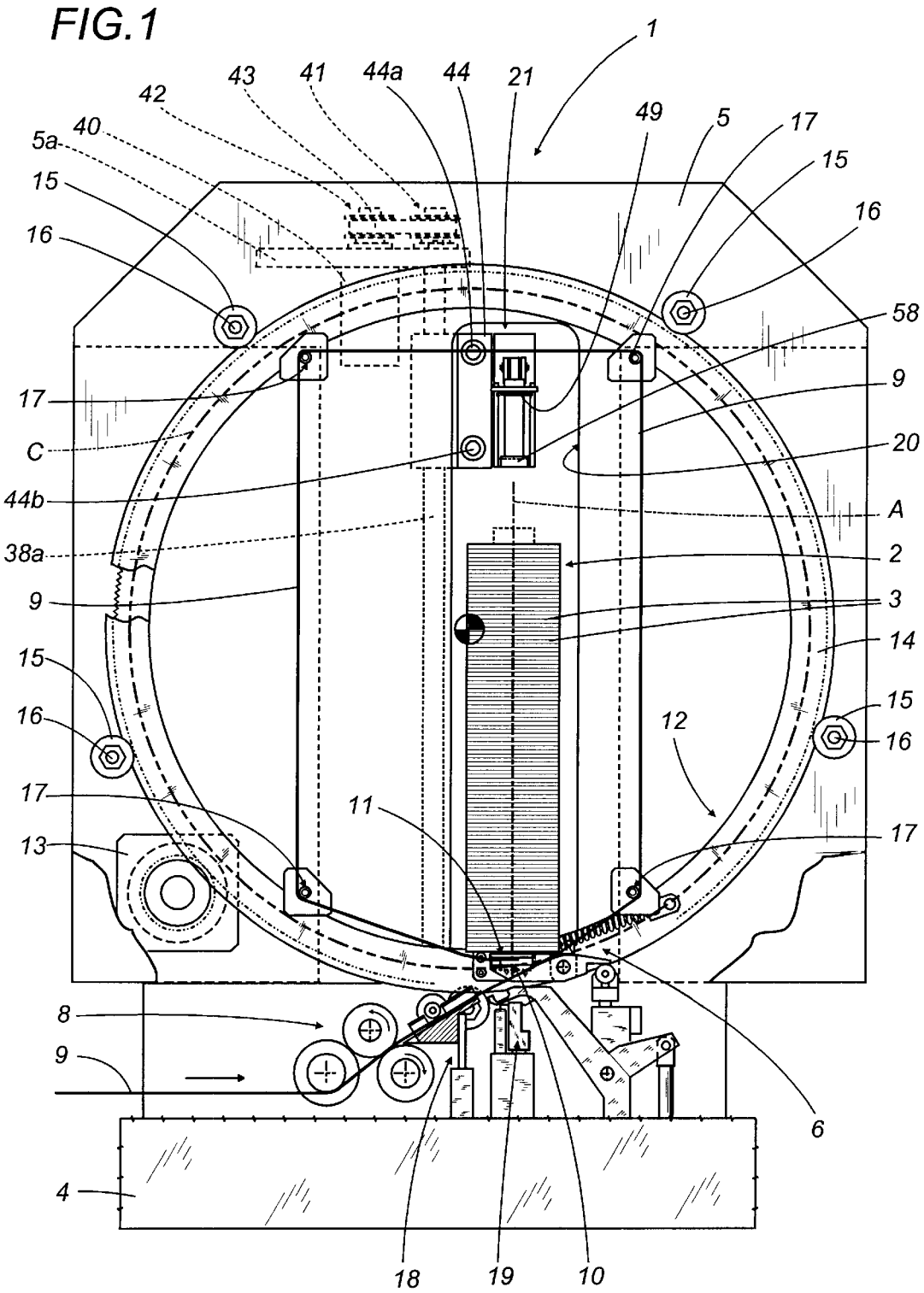
FIG. 1 illustrates a preferred embodiment of a banding device according to the present invention, shown schematically in a front elevation and with certain parts omitted for clarity.

Referring to FIG. 1 of the drawings, 1 denotes a device, in its entirety, for banding groups 2 of sheets consisting, in the example illustrated, of soiled banknotes 3. A device of the general type in question is disclosed in application B099A 000548 for Italian patent, to which reference may be made for a full description; such a device 1 typically comprises a bed or frame 4 supporting a vertical bulkhead 5. The bulkhead 5 in its turn supports a station 6 where at least one band 7 is fastened around a group 2 of banknotes 3 stacked along a longitudinal axis A in such a way that the group 2 appears substantially parallelepiped in shape when formed. The device 1 also comprises a feed unit 8 serving to direct a continuous strip 9 of material, from which the band 7 will be obtained ultimately, toward a gripper 10 that is positioned to take up the strip 9 and disposed in such a way that one jaw constitutes a locating surface 11 offered to the bottom of the group 2. The gripper 10 is carried and guided around a circular path C through the agency of a positioning mechanism 12 set in motion by a motor 13 and comprising an annular element 14 that occupies a plane parallel to the bulkhead 5, supported thus by a plurality of freely revolving grooved rollers 15 mounted to respective shafts 16 disposed with axes perpendicular to the bulkhead 5. Also forming part of the device 1 are a plurality of pivots 17 about which the strip 9 is looped, a cutter device 18 by which the band 7 is separated from the strip 9, and a sealing device 19 by which the band is secured.

In the example of FIG. 1 the bulkhead 5 presents an opening 20, extending longitudinally and parallel to the stacking axis A, through which a compacting device denoted 21 is able to address the group 2 of banknotes 3 positioned in the neighborhood of the banding station 6.

Figure 2:
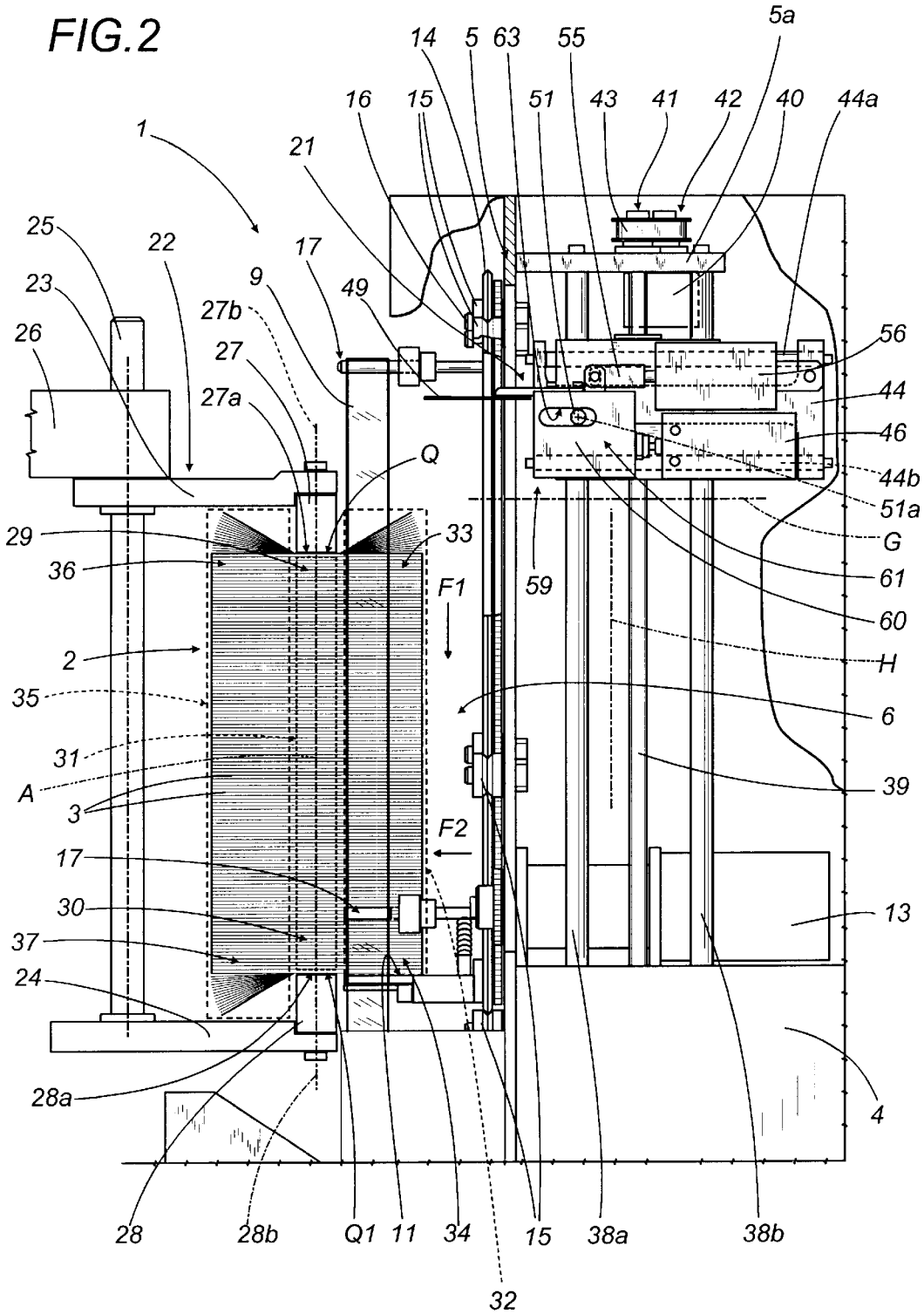
FIG. 2 illustrates the device of FIG. 1, shown schematically in a side elevation and with certain parts omitted for clarity.

As illustrated in FIG. 2, the group 2 of banknotes 3 is held in a gripping device 22 that operates by compressing the stacked notes between two arms 23 and 24, top and bottom respectively, connected to a column 25 supported in turn by drive means 26 of conventional embodiment illustrated only in part.

The arms 23 and 24 engage the group 2 of notes 3 by way of corresponding jaws 27 and 28 pivotable about respective axes 27*b* and 28*b* disposed parallel to the stacking axis A, impinging respectively on the top end 29 and the bottom end 30 of a first longitudinal portion 31 presented by the group 2. The jaws 27 and 28 are rotatable about the relative axes 27*b* and 28*b* and present respective mutually parallel surfaces 27*a* and 28*a* offered in contact to the group 2; each of the parallel surfaces 27*a* and 28*a* establishes a respective plane Q and Q1 lying substantially perpendicular to the stacking axis A and occupied by the corresponding ends 29 and 30 aforementioned.

The group 2 of banknotes 3 also presents a second longitudinal portion 32 extending parallel to the first portion 31 and, in a configuration assumed when the band 7 is applied, disposed facing the station 6. In like manner to the first portion 31, the second portion 32 presents two ends 33 and 34, top and bottom respectively, of which the bottom end 34 engages in contact with the aforementioned locating surface 11 when assuming a configuration in which the band 7 is applied.

The group 2 of banknotes 3 also presents a third longitudinal portion 35 extending parallel to the first and second portions 31 and 32. The third portion 35 is disposed facing the first portion 31 on the side opposite from the second portion 32 and, again in like manner to the first and second portions 31 and 32, presents two ends 36 and 37, top and bottom respectively.

The compacting device 21 is rendered capable of movement in a direction parallel to the stacking axis A along two columns 38*a* and 38*b* through the agency of a ballscrew type actuator 39 extending parallel to the columns 38*a* and 38*b* and driven in its turn by a conventional motor 40 coupled to a transmission composed of two pulleys 41 and 42 and a relative belt 43.

The columns 38*a* and 38*b* and the ballscrew 39 are supported by a horizontal plate 5*a* uppermost and mounted to the frame 4 at the bottom. The plate 5*a* is connected rigidly to the bulkhead 5 and serves also to support the motor 40.

As illustrated to advantage in FIGS. 3 to 8, the compacting device 21 comprises a first slide 44 rendered capable of movement on a second slide 45, in a direction G transverse to the stacking axis A, through the agency of an actuator 46 mounted to the second slide 45 with the rod 47 connected to the first slide 44.

Figure 8:
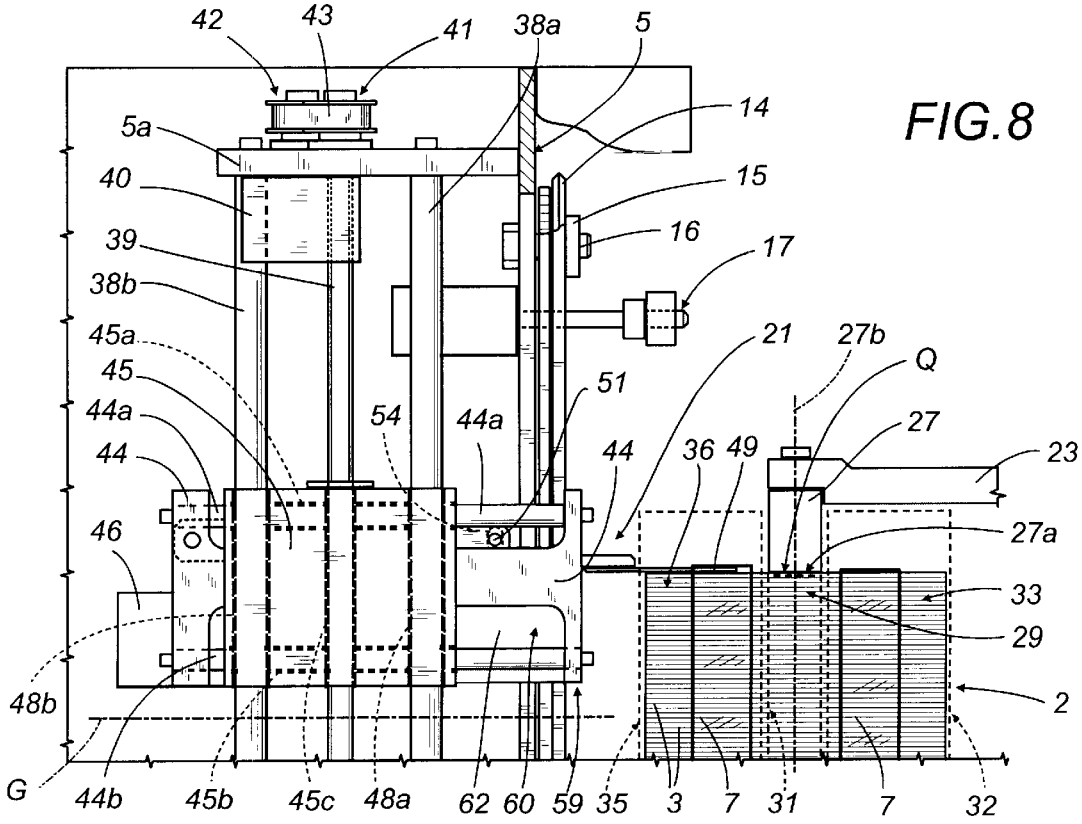
FIG. 8 shows the same details as in FIGS. 3 . . . 7 in a further operating step, viewed schematically in an elevation from the opposite side.

The first slide 44 exhibits the shape essentially of a letter "H" and presents two rods 44*a* and 44*b*, parallel one to another and both to the transverse direction G, slidable in respective cylindrical bores 45*a* and 45*b* afforded by the second slide 45 (see FIG. 8).

The first and second slides 44 and 45 move as one in the direction denoted H on the columns 38*a* and 38*b*, which are coupled with respective cylindrical bores 48*a* and 48*b* afforded by the selfsame second slide 45. The ballscrew actuator 39 engages with a threaded bore 45*c* afforded by the second slide 45.

The compacting device 21 comprises a finger 49 by which the banknotes 3 of the group 2 are compacted. The finger 49 is attached to a lever 50 mounted rotatably to a pivot 51 of which the axis 51*a* of rotation lies transverse to the stacking axis A.

The lever 50 presents a first or bottom end 52 and a second or top end 53. The top end 53 affords a pin-eye 54 by way of which the lever 50 is linked to the rod 55 of an actuator 56 mounted to the first slide 44. The bottom end incorporates a sector gear 57 of which the center of rotation coincides substantially with the axis 51*a* of the pivot 51.

The sector gear 57 meshes with a rack 58 afforded by one end 59 of the first slide 44, facing toward the banding station 6. Also rigidly associated with this same end 59 of the slide 44 is a housing 60 of parallelepiped shape occupied by the lever 50 and the rack 58, of which two faces 61 and 62 extend mutually parallel and perpendicular to the axis 51*a* of rotation of the pivot 51. Each face 61 and 62 presents a relative slot 63 extending substantially parallel to the transverse direction G, of which the function is to support and guide one respective end of the pivot 51.

In operation, observing FIG. 2, a group 2 of notes coming from an infeed station (not indicated in the drawings) is taken up between the arms 23 and 24 of the gripping device 22 and positioned by the drive means 26 next to the banding station 6.

The parts of the banknotes 3 coinciding with the opposite ends 29 and 30 of the first longitudinal portion 31 of the group 2 are constrained by the jaws 27 and 28 of the two arms 23 and 24 to occupy planes parallel with the planes Q and Q1 defined by the respective surfaces 27*a* and 28*a* of the selfsame jaws 27 and 28, which engage in direct contact with the top and bottom banknotes 3 of the group 2.

The gripping action of the jaws 27 and 28 on the ends 29 and 30 of the first longitudinal portion 31 has the effect also of compressing the group 2, and as a direct result of this compression there will be a fanning-out of those parts of the banknotes 3 coinciding with the opposite ends 33–34 and 36–37 of the longitudinal portions 32 and 35 not subject to the gripping action of the jaws 27 and 28.

As discernible in FIG. 2 the gripping device 22 is caused by the drive means 26 to place the bottom end 34 of the second longitudinal portion 32 on the locating surface 11 afforded by the gripper 10, in direct contact, occupying the same plane Q1 as that established by the adjacent jaw 28. This is brought about by a combination of two movements: first, the group 2 is translated parallel with the stacking axis A in the direction of the arrow denoted F1 and into contact with the locating surface 11, thereby eliminating the fanned-out effect at the end 34 of the longitudinal portion 32 and causing the parts of the notes nearest this same end 34 to assume a configuration parallel with the gripping plane Q1; second, the group 2 is translated parallel to the transverse direction G and in the direction of the arrow denoted F2 in such a way as to smooth those parts of the notes lying at the end 34 in contact with the locating surface 11.

Figure 3:
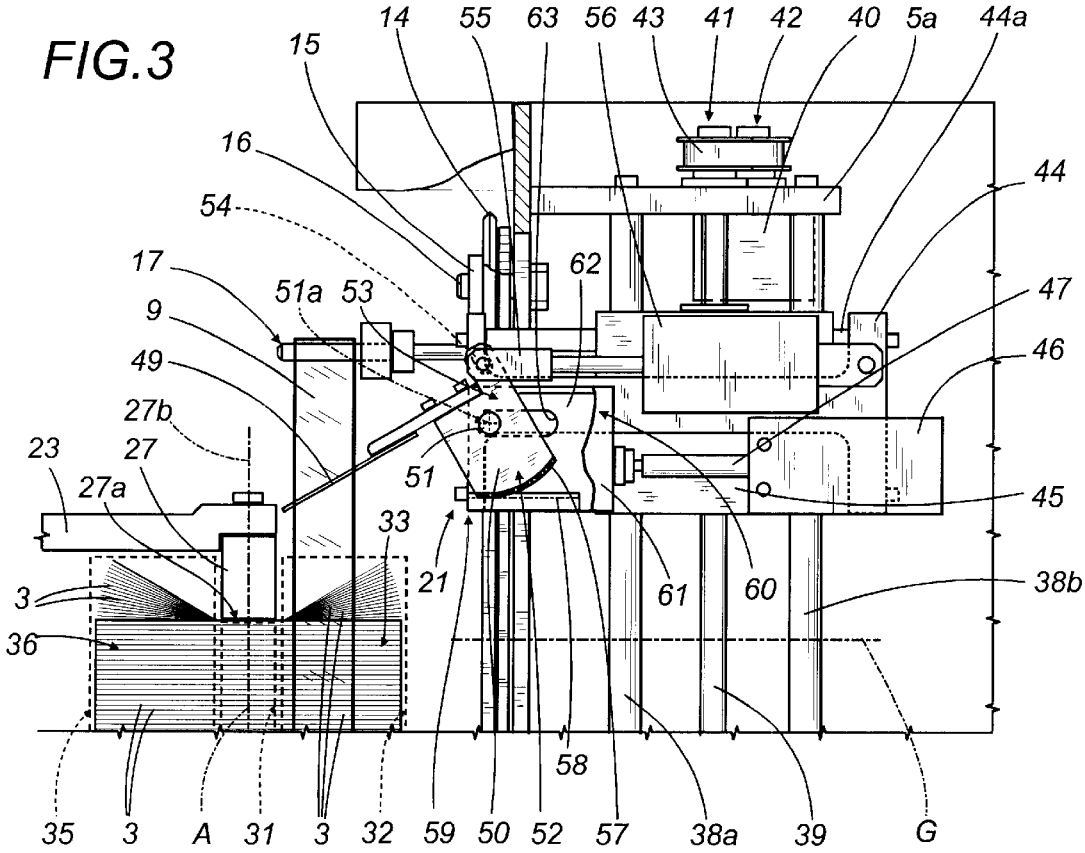
FIGS. 3 to 7 illustrate certain details of FIG. 2, shown schematically in a side elevation and in a succession of operating steps.

In the position of FIG. 3, the finger 49 of the compacting device 21 is angled downwards by the actuator 56, of which the extending movement forces the top end 52 of the lever 50 to rotate, causing the sector gear 57 to interact with the rack 58.

Figure 4:
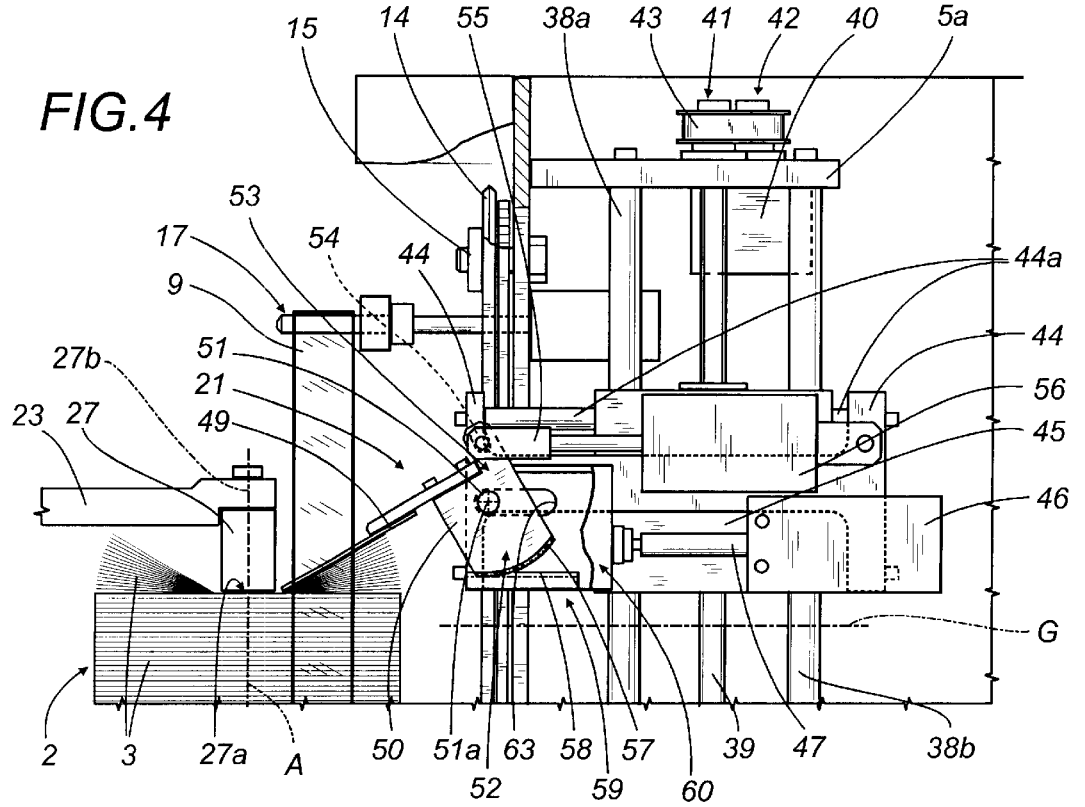

With the finger 49 occupying this angled position the compacting device 21 is translated downwards, en bloc, by the action of the ballscrew 39 and the motor 40, following the direction denoted H to the point at which the selfsame finger 49 is brought into contact with the fanned-out banknotes 3 at the top end 33 of the second longitudinal portion 32 of the group 2, as indicated in FIG. 4.

As soon as the finger 49 enters into contact with the banknotes 3, the group 2 will begin to oppose the compressive action of the descending device 21, generating a reaction force which is transmitted by degrees to the finger 49. The reaction force does not halt the downward progress of the compacting device 21, but causes the finger 49 to describe a movement made up of three distinct components, the first a rotational movement about the axis 51*a* of the pivot 51, the second a translational movement relative to the group 2 of notes in the transverse direction G, and the third, a downward movement resulting from the aforementioned descent of the entire compacting device 21 in the direction H parallel to the stacking axis A.

Figure 5:
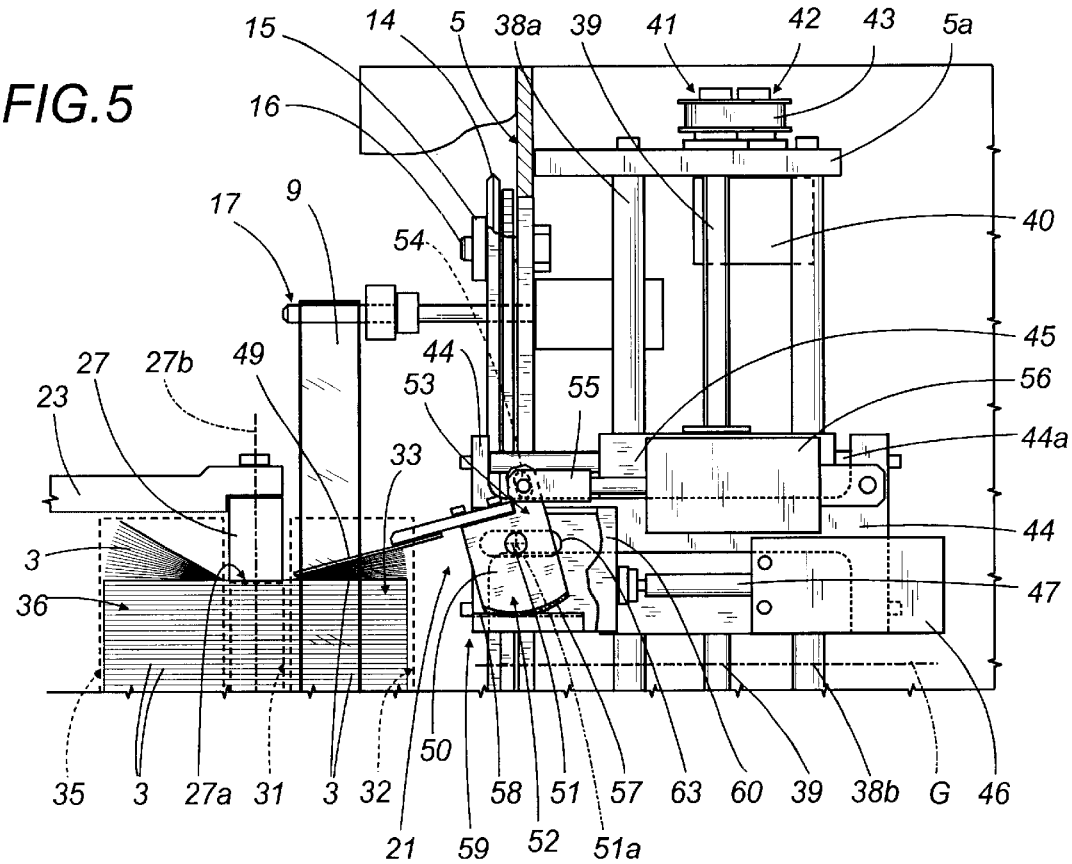
Figure 6:
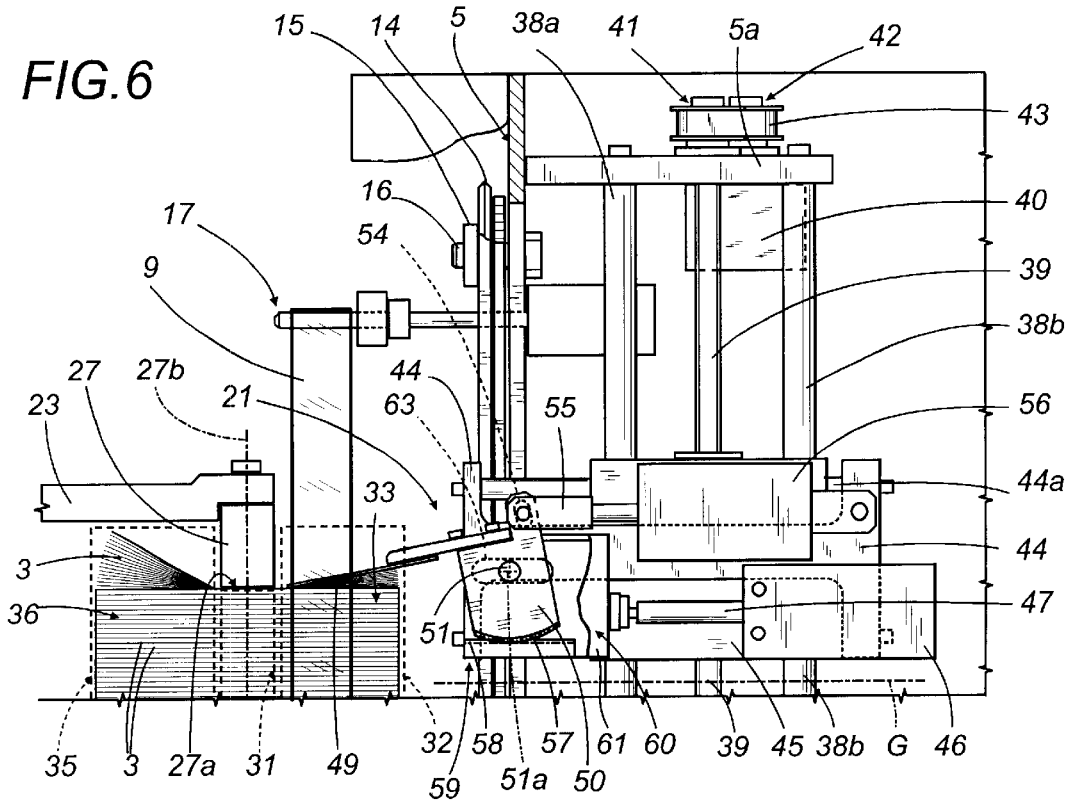
Figure 7:
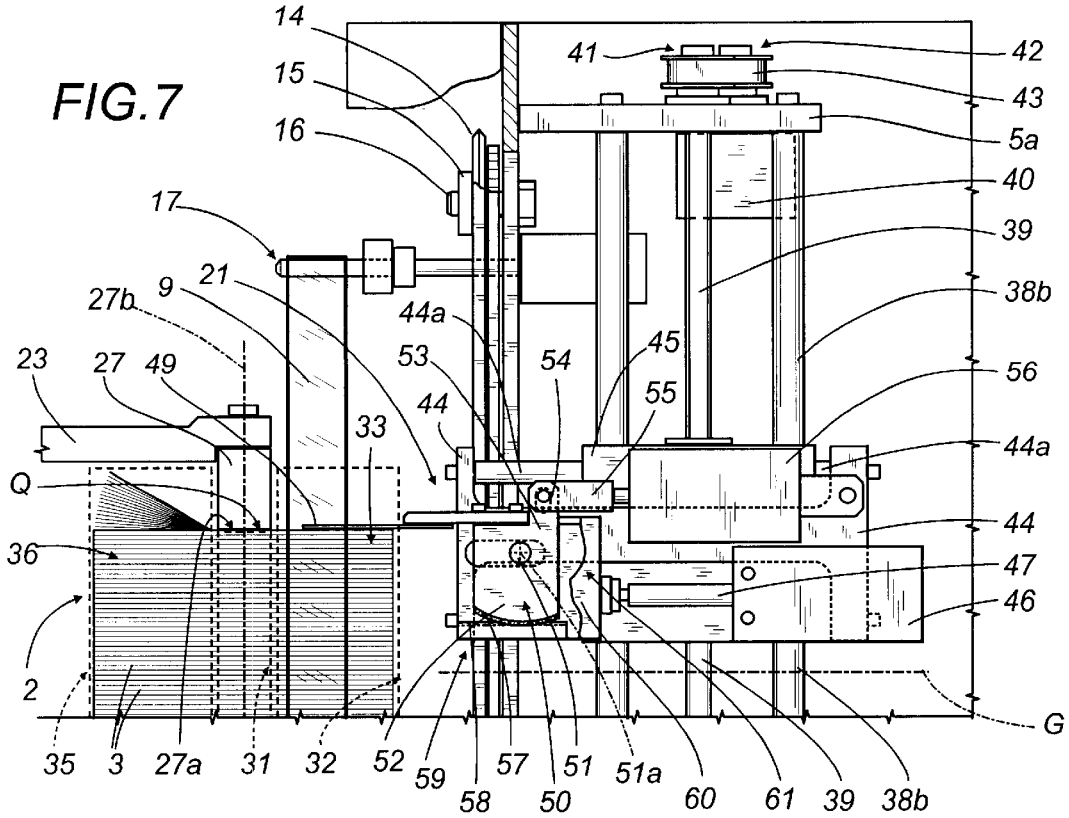

As illustrated sequentially in FIGS. 5, 6, and 7, the relative motion between the finger 49 and the group 2 of notes 3 has the effect of gradually eliminating the fanned-out configuration at the top end 33 of the longitudinal portion 32, bringing the corresponding notes substantially parallel with the plane Q of the relative jaw 27 and smoothing them at one and the same time.

FIG. 7 illustrates a group 2 of banknotes 3 ready for the application of the band 7, after the manner described in reference B099A 000548 above.

Once a band 7 of strip material 9 has been placed around the second longitudinal portion 32 of the group 2 of banknotes 3, as illustrated in FIG. 8, the jaws 27 and 28 of the gripping device 22 are caused to rotate about their respective axes 27*b* and 28*b* and position the group 2 with the third longitudinal portion 35 facing the station 6 in readiness for the application of a second band 7. At this point, operating in conjunction with the locating surface 11 and accomplishing a series of steps identical to those described and illustrated in FIGS. 3 to 7, the compacting device 21 will proceed to compact and smooth the ends 36 and 37 presented by the third longitudinal portion 35 of the group 2.

Thereafter, the gripping device 22 is caused by the drive means 26 to distance the banded group 2 of banknotes 3 from the station 6, so that the banding device 1 can admit a further group 2.

Figure 9:
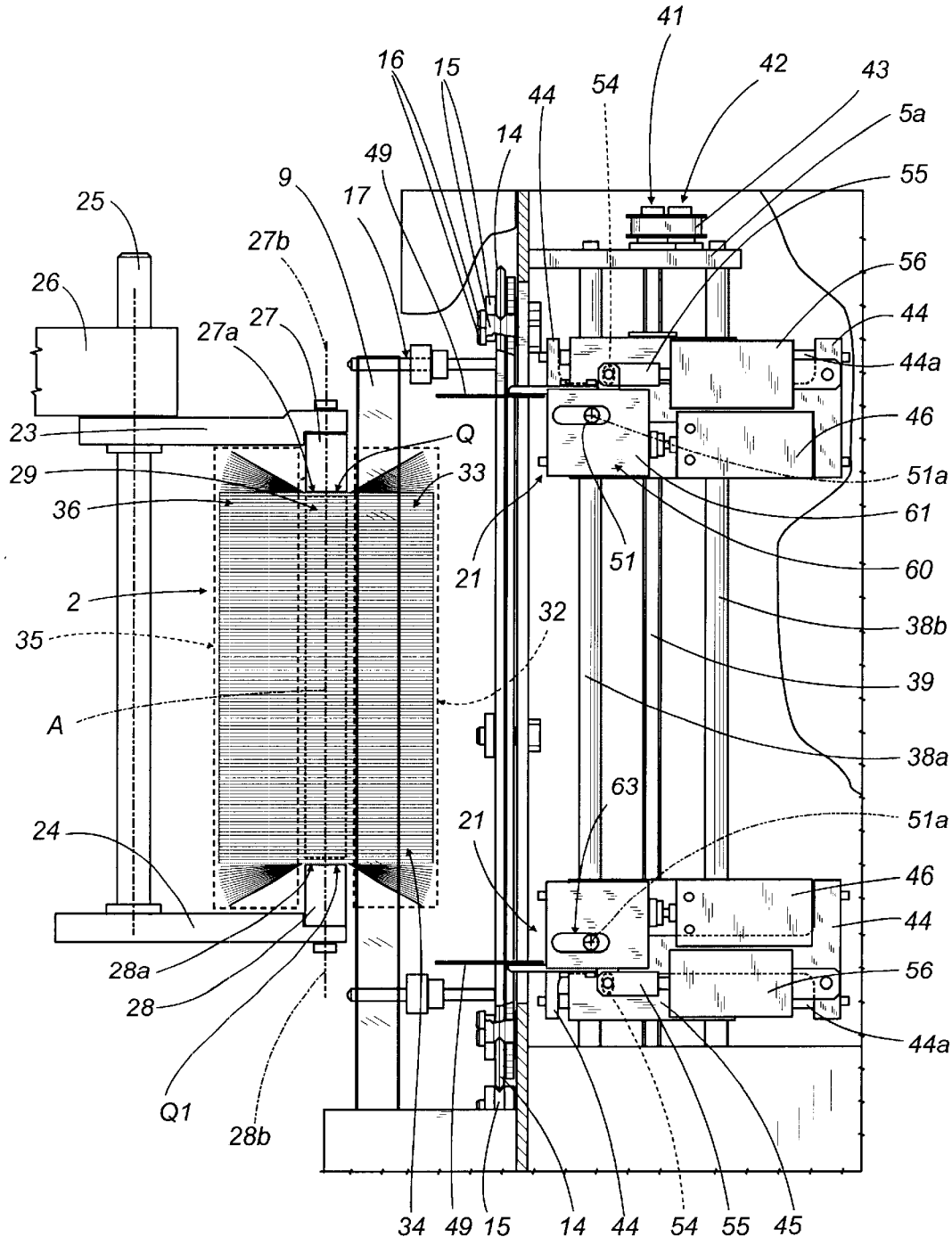
FIG. 9 illustrates a further embodiment of the device in FIG. 1, viewed schematically in a side elevation.

FIG. 9 shows an alternative embodiment of the banding device 1 that comprises a second compacting device 21 located below the group 2 in such a way as to interact with the bottom end 34 of the second longitudinal portion 32, thereby dispensing with the locating surface 11. The second slides 45 of the two compacting devices 21 will have respective bores 45*a* with threads of opposite hand coupled to a single ballscrew 39, so that the slides are drawn together along the direction H of movement when the screw rotates in one direction, and distanced one from the other along the selfsame direction H when the screw rotates in the opposite direction.

What is claimed is:

1. A device for banding groups of sheets appearing substantially parallelepiped in shape, wherein the sheets are made to accumulate along a longitudinal stacking axis, taken up by respective gripping means engaging two longitudinally opposite ends of at least a first longitudinal portion of the resulting group, and fed thus to a station where at least one band of a strip material is applied comprising compacting means designed to compress at least a second longitudinal portion of the single group not engaged by the gripping means, in such a manner as to position the group of sheets in a configuration of readiness for application of the band.

2. A device as in claim 1, comprising gripping means embodied in the manner of a clamp such as will compress the first longitudinal portion in a direction parallel to the longitudinal stacking axis and establish planes disposed substantially perpendicular to the stacking axis which the two ends of the first longitudinal portion of the group are constrained respectively to occupy, wherein the parts of the sheets that constitute the second longitudinal portion of the group, not engaged by the gripping means, are caused to fan out at least partially during the compressing action, the second portion presents a first end and a second end located at the top and bottom opposite extremities of the group along the longitudinal stacking axis, and the compacting means comprise at least one finger impinging on one of the two ends of the second longitudinal portion in such a way as to compact the selfsame second longitudinal portion and bring the end into a position substantially occupying the respective plane.

3. A device as in claim 2, wherein the finger impinges on the second longitudinal portion of the group of sheets describing a movement in relation to the selfsame second portion that is dictated by a law of motion deriving from a combination of at least two distinct components, of which a first consists in an angular movement of the finger about an instantaneous axis of rotation transverse to the longitudinal stacking axis, and a second consists in a rectilinear movement of the finger and the group of sheets one relative to another, parallel with the longitudinal stacking axis.

4. A device as in claim 3, wherein the law of motion dictating the movement of the finger comprises a third component, consisting in a rectilinear movement along a direction transverse both to the instantaneous axis of rotation and to the longitudinal stacking axis, serving to smooth the second longitudinal portion.

5. A device as in claim 3 or 4, wherein the finger impinges on one end of the second longitudinal portion, operating in conjunction with a substantially flat locating surface disposed perpendicular to the longitudinal stacking axis and impinging on the opposite end, in such a way as to compact and smooth the second longitudinal portion.

6. A device as in claim 5, wherein the locating surface and the group of sheets are invested with relative motion deriving from a combination of at least two components, of which a first consists in a rectilinear movement parallel with the stacking axis whereby the surface and the group are brought into contact one with another and a second consists in a rectilinear movement one relative to the other along the direction transverse to the stacking axis.

7. A device as in claims 2 3, or 4, wherein the finger is carried by a first slide capable of movement in a direction parallel to the stacking axis at least between a first raised limit position in which the compacting device is at rest, and a second lowered limit position in which the group of sheets is compacted.

8. A device as in claim 7, wherein the first slide is slidably associated with a second slide, capable of movement in relation thereto along the transverse direction between an at-rest position in which the finger lies outside the dimensional compass of the banding station and an operating position in which the finger is disposed within the compass of the station, the second slide being slidably associated with at least one respective guide column extending parallel to the longitudinal stacking axis.

9. A device as in claim 2, 3, or 4, wherein the finger is secured to a lever rotatable about a pivot, of which the axis coincides with the axis of rotation, and presenting a downwardly directed first end affording a sector gear concentric with the pivot and meshing with a rack afforded by the first slide, the pivot being slidably translatable in a slot integral with the first slide and disposed substantially parallel to the rack.

10. A device as in claim 9, wherein the lever presents an upwardly directed second end connected to an actuator carried by the first slide and serving to move the finger between an at-rest position substantially parallel with the locating surface, and an operating position of engagement with the group in which the finger is angled as the result of the lever being rotated about the axis of the pivot.

11. A device as in claim 4, comprising two fingers impinging respectively on the two ends of the second longitudinal portion.

12. A device as in claim 5 wherein the finger is carried by a first slide capable of movement in a direction parallel to the stacking axis at least between a first raised limit position in which the compacting device is at rest, and a second lowered limit position in which the group of sheets is compacted.

13. A device as in claim 12, wherein the first slide is slidably associated with a second slide, capable of movement in relation thereto along the transverse direction between an at-rest position in which the finger lies outside the dimensional compass of the banding station and an operating position in which the finger is disposed within the compass of the station, the second slide being slidably associated with at least one respective guide column extending parallel to the longitudinal stacking axis.

14. A device as in claim 6 wherein the finger is carried by a first slide capable of movement in a direction parallel to the stacking axis at least between a first raised limit position in which the compacting device is at rest, and a second lowered limit position in which the group of sheets is compacted.

15. A device as in claim 14, wherein the first slide is slidably associated with a second slide, capable of movement in relation thereto along the transverse direction between an at-rest position in which the finger lies outside the dimensional compass of the banding station and an operating position in which the finger is disposed within the compass of the station, the second slide being slidably associated with at least one respective guide column extending parallel to the longitudinal stacking axis.

16. A device as in claim 5 wherein the finger is secured to a lever rotatable about a pivot, of which the axis coincides with the axis of rotation, and presenting a downwardly directed first end affording a sector gear concentric with the pivot and meshing with a rack afforded by the first slide, the pivot being slidably translatable in a slot integral with the first slide and disposed substantially parallel to the rack.

17. A device as in claim 16, wherein the lever presents an upwardly directed second end connected to an actuator carried by the first slide and serving to move the finger between an at-rest position substantially parallel with the locating surface, and an operating position of engagement with the group in which the finger is angled as the result of the lever being rotated about the axis of the pivot.

18. A device as in claim 6 wherein the finger is secured to a lever rotatable about a pivot, of which the axis coincides with the axis of rotation, and presenting a downwardly directed first end affording a sector gear concentric with the pivot and meshing with a rack afforded by the first slide, the pivot being slidably translatable in a slot integral with the first slide and disposed substantially parallel to the rack.

19. A device as in claim 18, wherein the lever presents an upwardly directed second end connected to an actuator carried by the first slide and serving to move the finger between an at-rest position substantially parallel with the locating surface, and an operating position of engagement with the group in which the finger is angled as the result of the lever being rotated about the axis of the pivot.

20. A device as in claim 7 wherein the finger is secured to a lever rotatable about a pivot, of which the axis coincides with the axis of rotation, and presenting a downwardly directed first end affording a sector gear concentric with the pivot and meshing with a rack afforded by the first slide, the pivot being slidably translatable in a slot integral with the first slide and disposed substantially parallel to the rack.

21. A device as in claim 20, wherein the lever presents an upwardly directed second end connected to an actuator carried by the first slide and serving to move the finger between an at-rest position substantially parallel with the locating surface, and an operating position of engagement with the group in which the finger is angled as the result of the lever being rotated about the axis of the pivot.

22. A device as in claim 8 wherein the finger is secured to a lever rotatable about a pivot, of which the axis coincides with the axis of rotation, and presenting a downwardly directed first end affording a sector gear concentric with the pivot and meshing with a rack afforded by the first slide, the pivot being slidably translatable in a slot integral with the first slide and disposed substantially parallel to the rack.

23. A device as in claim 22, wherein the lever presents an upwardly directed second end connected to an actuator carried by the first slide and serving to move the finger between an at-rest position substantially parallel with the locating surface, and an operating position of engagement with the group in which the finger is angled as the result of the lever being rotated about the axis of the pivot.

* * * * *